United States Patent [19]

Flake

[11] Patent Number: 4,836,549

[45] Date of Patent: Jun. 6, 1989

[54] MULTI-FACETED PUZZLE TOY

[76] Inventor: James T. Flake, 274 Mountain Rd., Evanston, Wyo. 82930

[21] Appl. No.: 788,126

[22] Filed: Oct. 16, 1985

[51] Int. Cl.[4] ..... A63F 9/08

[52] U.S. Cl. ..... 273/153 S

[58] Field of Search ..... 273/153 S, 153 R; 446/489, 487

[56] References Cited

U.S. PATENT DOCUMENTS 4,496,155 1/1985 Goldfarb ..... 273/153 S

FOREIGN PATENT DOCUMENTS 1127609 12/1984 U.S.S.R. ..... 273/153 S 2084471 4/1982 United Kingdom ..... 273/153 S

*Primary Examiner*—Mickey Yu

*Attorney, Agent, or Firm*—B. Deon Criddle

[57] ABSTRACT

A multi-faceted toy having eight heptahedrons that are anchored to a central sphere; four of the heptahedrons are each attached directly to the central sphere with internal axles that have one end anchored securely in the central sphere; the other four heptahedrons are mounted on axles which are anchored to a convex base plate that is movable and that can be rotated in an orbit around the central sphere by means of an internal tongue and groove system which provides raceways for movement as well as interlocking of the individual components to the central sphere.

8 Claims, 5 Drawing Sheets

MULTI-FACETED PUZZLE TOY

BACKGROUND OF THE INVENTION

1. Field of the Invention

This invention relates to toys and amusement devices and is particularly concerned with devices having multiple geometric faces mounted to a central sphere and with face components being movable with respect to faces and the faces movable with respect to the sphere.

2. Prior Art

Toys having interconnected movable components that are arranged to be manipulated by a user into one or more derived patterns have long been known.

U.S. Pat. No. 4,377,916, for example, discloses a chain-like toy made of plurality of isosceles triangular hollow prism units interconnected for rotation of the units.

U.S. Pat. No. 4,325,552, discloses a series of sphere elements connected by a common axis through heir centers and rotatable about their axis.

U.S. Pat. Nos. 3,845,959 and 4,378,116, show toys in which blocks are combined to form a larger block or cube and with the individual blocks being movable on axes to change their relative positions in the larger block or cube and/or to change the orientation of the individual blocks with respect to the larger block.

U.S. Pat. No. 4,344,623 discloses a toy having a central part with a central canopy members defining tracks for movable blocks that are movable relative to the central part.

U.S. Pat. No. 3,840,234 discloses an amusement device comprising a transparent main tetrahedron, a central tetrahedron, each of the sides of the central tetrahedron forming a side of an octohedron, an unapertured transparent planer member and a set of balls adapted to be moved into and out of corners of the main tetrahedron by manipulation of the main tetrahedron.

While the above identified prior art references disclose games of the same general type as that of the present invention, they do not provide the same challenge to a user as results during the use of the present invention.

OBJECTS OF THE INVENTION

Principal features of the present invention are to provide a multi-faceted toy having multiple projecting faces that can be manipulated relative to a central supporting member and with the components of the faces also being individually manipulated to change their orientation relative to the faces.

FEATURES OF THE INVENTION

The present invention comprises a multi-faceted toy including eight heptahedrons. Each heptahedron is made up of five individual components. Each of the eight heptahedrons is attached to a central sphere by means of an internal axle Four of the internal axles are attached directly into the sphere and the other four axles are attached to a convex base plate which is interlocked to the central sphere by a system of internal tongue and groove raceway that key the individual components together around the central sphere and provide a means for orbiting the components around the sphere into other positions. The axles each provide another axis, independent of the sphere, about which the individual components can rotate to change the orientation of the faceted faces of each of the eight heptahedrons components.

The variety of positions and the orbiting of the movable heptahedrons around the internal sphere, as well as the rotating of the individual heptahedron components about their internal axles result in a toy that is both entertaining and challenging in the movement of components.

The complexity and challenge may be further enhanced by the use of color or texture on the faceted sides of each component.

Other objects and features of the invention will become apparent from the following detailed description and drawing disclosing what are presently contemplated as being the best modes of the invention. THE DRAWING In the drawing FIG. 1, is a perspective view of the invention in the assembled state;

FIG. 2, a perspective view as in FIG. 1, with two heptahedrons exploded away from the central sphere, the foremost heptahedron exploded away from the central sphere as an assembled heptahedron, and another heptahedron further exploded to show the individual components that make up the typical heptahedron;

FIG. 3, a cross section view taken along section line 3—3 of FIG. 1.

FIG. 4, a top plan view of a typical one of the identical eight tetrahedron components;

FIG. 4A, a front elevation view of a tetrahedron component;

FIG. 4B, a side elevation view of a tetrahedron component;

FIG. 4C, a bottom plan view of a tetrahedron component;

FIG. 4D, a cross section view taken on the line 4D—4D of FIG. 4C;

FIG. 5, a top plan view of the identical four rotatable octahedron components;

FIG. 5A, a front elevation view of a typical rotatable octahedron component;

FIG. 5B, a side elevation view of a rotatable octahedron component;

FIG. 5C, a bottom plan view of a rotatable octahedron component;

FIG. 6, a top plan view of a typical one of the identical twelve pentagonal shaped components;

FIG. 6A, a front elevation view of a pentagonal shaped component;

FIG. 6B, a side elevation view of a pentagonal shaped component;

FIG. 6C, a bottom plan view of a pentagonal shaped component;

FIG. 6D, a cross section view taken on line 6D—6D of FIG. 6C;

FIG. 7, a top plan view of a typical one of the identical four movable octahedron shaped components;

FIG. 7A, a front elevation view of a movable octahedron shaped component;

FIG. 7B, a side elevation of a movable octahedron shaped component;

FIG. 7C, a bottom plan view of a movable octahedron shaped component;

FIG. 8, a side elevation view of a typical one of the identical six pyramidal shaped base interlock components;

FIG. 8A, a side elevation view of the pyramidal shaped base interlock component;

FIG. 8B, a top plan view of the pyramidal shaped base interlock component;

FIG. 8C, a cross section view taken on line 8C—8C of FIG. 8B;

FIG. 8D, a bottom plan view of the pyramidal shaped base component;

FIG. 9, a top plan view of a typical one of the identical four convex base plates;

FIG. 9A, a front elevation view of a convex base plate;

FIG. 9B, a side elevation view of a convex base plate;

FIG. 9C, a bottom plan view of a convex base plate;

FIG. 10, a top plan view of a typical one of the identical twelve pentagonal shaped components;

FIG. 10A, a front elevation view of a pentagonal shaped component;

FIG. 10B, a side elevation view of a pentagonal shaped component;

FIG. 10C, a bottom plan view of a pentagonal shaped component;

FIG. 10D, a cross section view taken on line 10D–10D of FIG. 10C;

FIG. 11, a top plan view of the toy;

FIG. 12, a front elevation view of the toy;

FIG. 13, a bottom plan view of the toy;

FIG. 14, a side elevation view of the top; and

FIG. 15, a back elevation view of the toy.

DETAILED DESCRIPTION OF THE DRAWING

Referring now to the drawings

Figure 1:
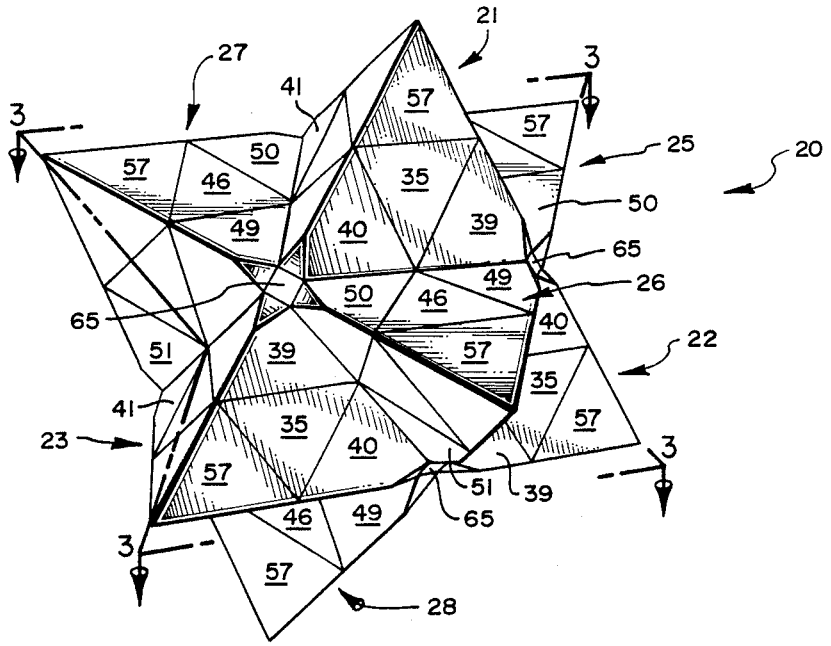

The toy of the invention is shown generally at 20. As shown, the toy includes eight heptahedrons shown generally at 21, 22, 23, 24, 25, 26, 27 and 28, FIGS. 1, 11, 13, 14 and 15. Each of the heptahedrons is positioned around an internal central sphere 29 shown best in FIG. 3. Four of the heptahedrons 21, 22, 23 and 24 are positioned on sphere 29 by means of stationary internal axles 30 that are threaded at 31 and that are screwed into sphere 29. The heptahedrons 21, 22, 23 and 24 to sphere 29 are thus anchored in a stationary location with respect to sphere 29. The remaining four heptahedrons 25, 26, 27 and 28 are secured to sphere 29 by internal axles 32 which are anchored to movable octahedron shaped base plates 33. The octahedron shaped base plates 33 allow the base plates as well as the orbital heptahedrons they support, to orit around sphere 29. Thus heptahedrons 25, 26, 27 and 28 are referred to as orbital heptahedrons since they can orbit around sphere 29, as well as rotate about their internal axles. All eight heptahedrons are anchored by internal axles and each is free to rotate 360 degrees about its internal axle. However, only four of the eight heptahedron's internal axles are mounted to the movable base plates so that these heptahedrons will also orbit around sphere 29.

Figure 2:
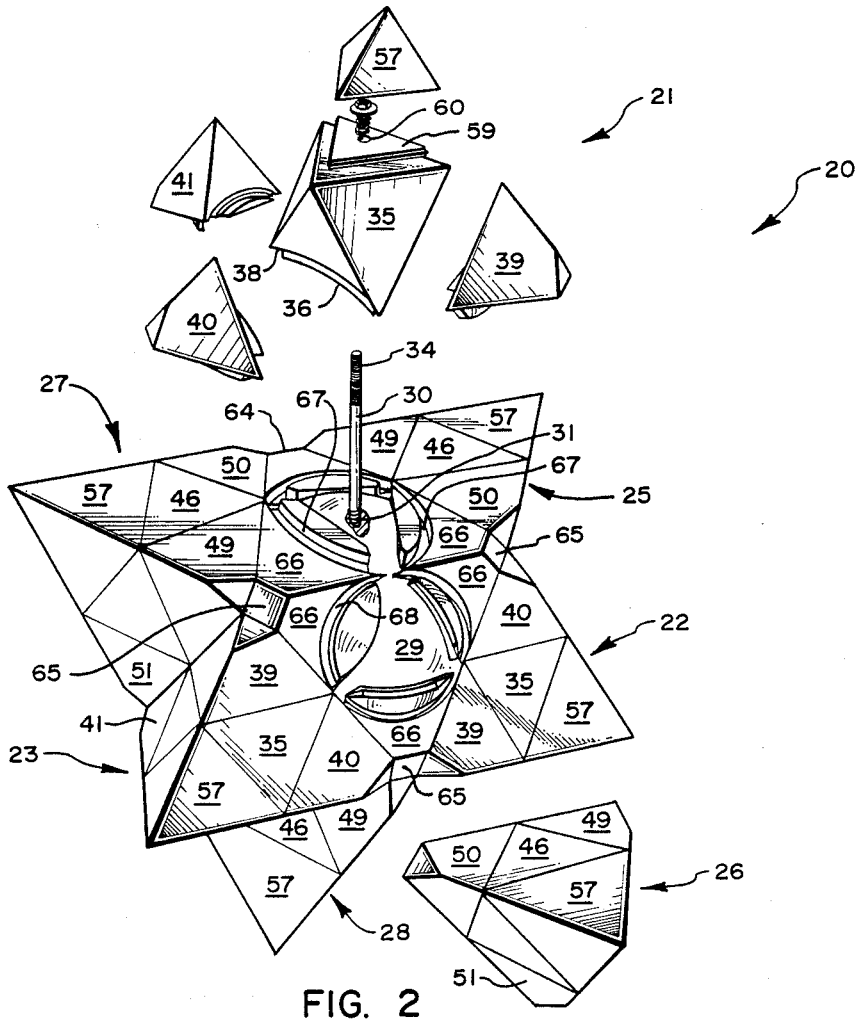

In FIG. 2 heptahedron 21 is shown exploded away from the central sphere 29. As shown, heptahedron 21 is anchored directly to the sphere 29 by means of its internal axle 30 as previously described. Thus axle 30 has one threaded end 31 anchored directly into sphere 29 and the other threaded end 34 is positioned to receive a locking nut. The heptahedrons 21, 22, 23 and 24 are each made up of five individual components that are positioned around a core octahedron component 35, which is shaped as an irregular octahedron having a concave base surface 36 that aligns with sphere 29. A hole 37 is bored through octahedron core 35 and provides the method or sliding the core component 35 over axle 30. Octahedron core 35 contains a continuous grooved raceway 38 around the perimeter edge of its concave base surface 36. This provides a locking method for catching the tongue of other components and anchoring them to sphere 29, as will be further explained, as well as providing a guide raceway for travel of other components. Positioned on the faceted sides of octahedron core 35 are three identical pentagonal shaped components 39, 40 and 41. These pentagonal shaped components pivot around the axis of axle 30 at the same time heptahedrons 21, 22, 23 or 24 are rotated.

Figure 3:
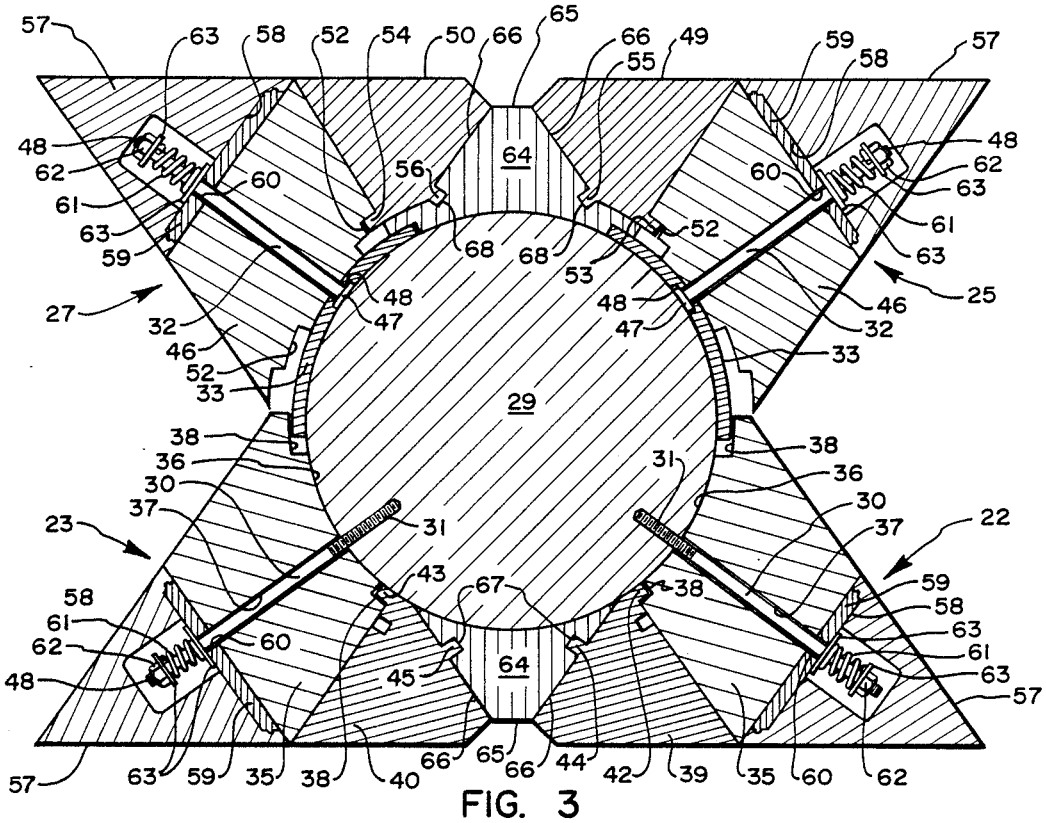
Figure 4:
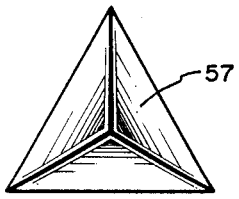
Figure 5:
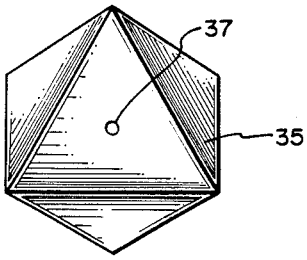
Figure 4A:
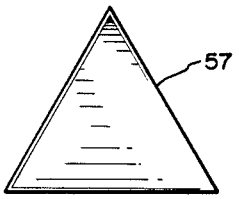
Figure 4B:
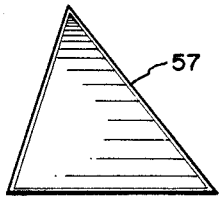
Figure 5A:
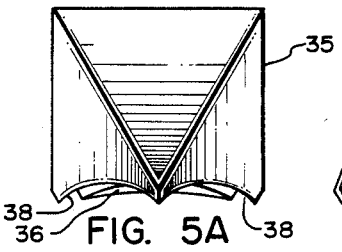
Figure 5B:
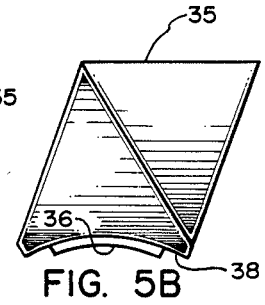
Figure 4C:
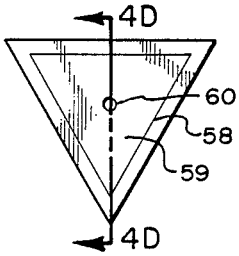
Figure 4D:
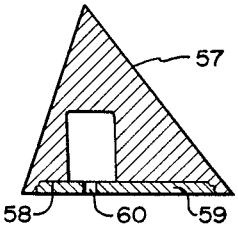
Figure 5C:
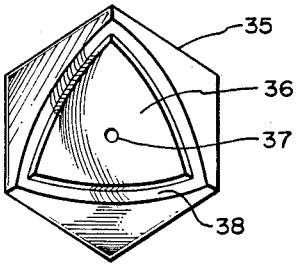
Figure 6:
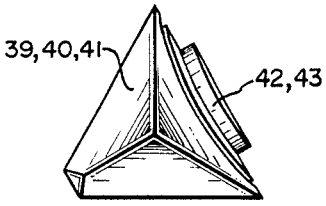
Figure 7:
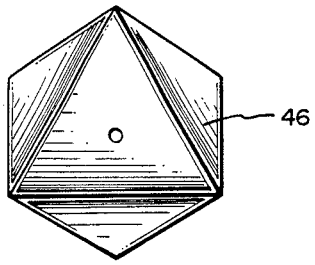
Figure 6A:
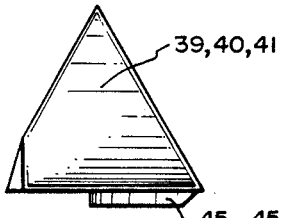
Figure 6B:
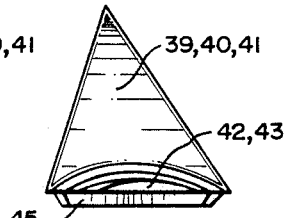
Figure 7A:
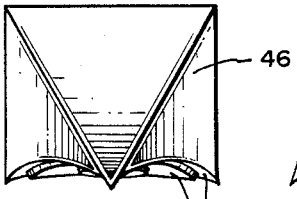
Figure 7B:
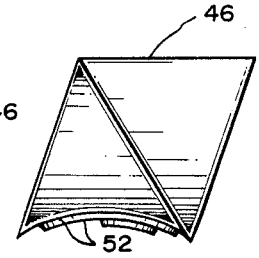
Figure 6C:
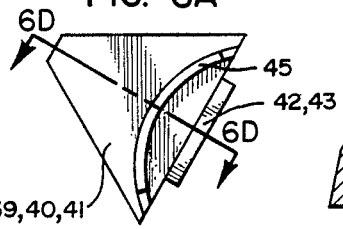
Figure 6D:
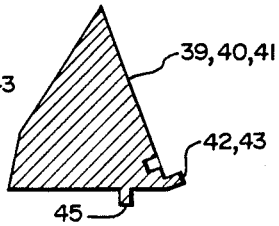
Figure 7C:
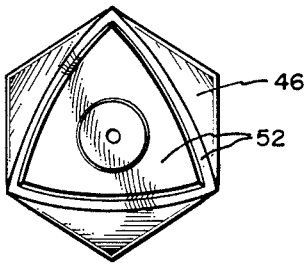
Figure 8:
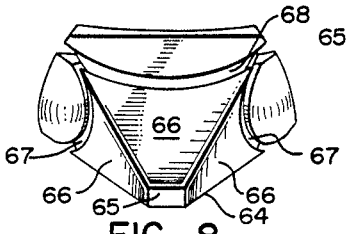
Figure 8A:
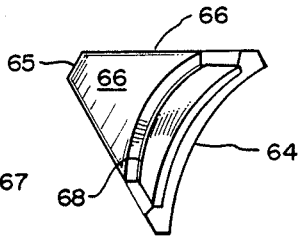
Figure 9:
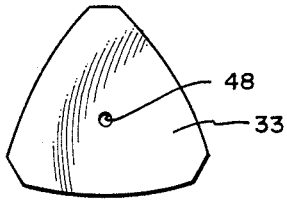
Figure 8B:
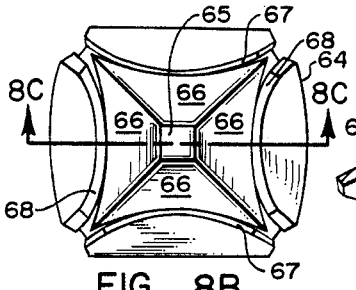
Figure 8C:
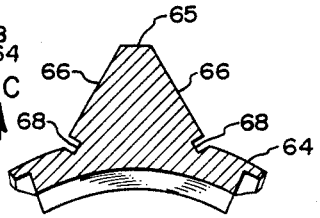
Figure 9A:
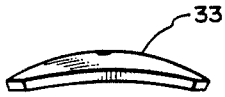
Figure 9B:
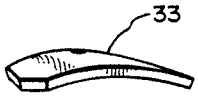
Figure 8D:
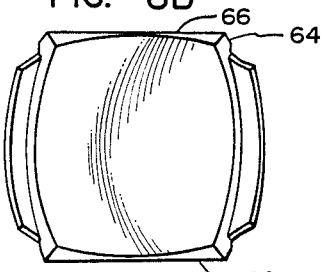
Figure 9C:
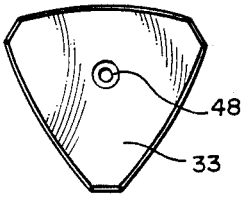
Figure 10:
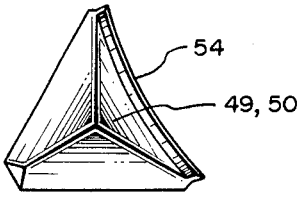
Figure 10A:
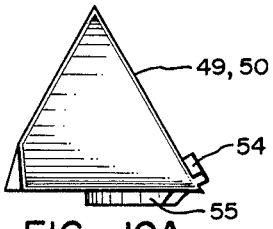
Figure 10B:
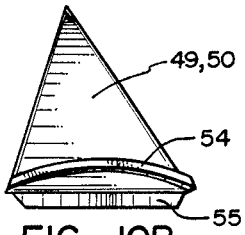
Figure 10C:
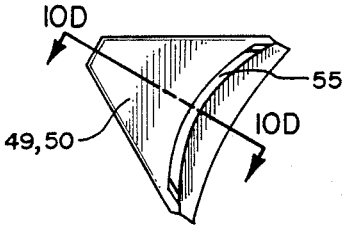
Figure 10D:
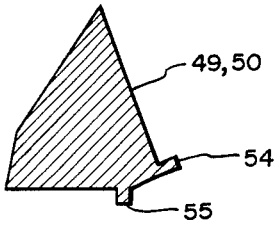
Figure 11:
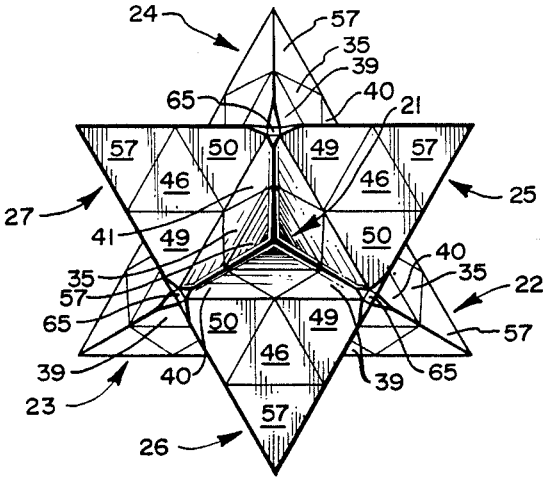

As best shown in FIG. 3, the pentagonal shaped components 39 and 40 are held in position and are secured to the toy by means of tongues 42 and 43 which interlock beneath grooves 38 of the central octagonal core pieces 35 of heptahedrons 22 and 23. Also tongues 44 and 45 extend into corresponding grooves in adjoining components. This tongue and groove system provides a method for interlocking all the toy components that are not directly anchored to the sphere by axles 30. Additionally the grooves provide raceways for the component parts to travel in as they orbit about the sphere. Heptahedrons 25, 26, 27 and 28 also include an orital octahedron core component 46. However orbital octahedron core 46 is mounted on a movable base plate 33 by means of an internal axle 32 which has a disk shaped end 47 that extends into a recessed dish shaped hole 48 in base plate 33. The opposite end of axle 32 is threaded at 48 to receive a locking nut. Heptahedrons 25, 26, 27 and 28 also have three pentagonal shaped components 49, 50 and 51 and are also positioned on the faceted sides of octagonal core 46 Similarly the pentagonal shaped components 49 and 50, FIG. 3, are secured in to the orbital octahedron core 46 by its base groove 52 which locks over tongues 53 and 54 of the components 49 and 50. Pentagonal shaped components 49, 50 and 51 also contain tongues 55 and 56 which project into with corresponding grooves in adjoining components.

At the vertex of each of the eight heptahedrons 21, 22, 23, 24, 25, 26, 27 and 28 is a triangular shaped tetrahedron component 57. Each tetrahedron component 57 is formed with a recessed base area 58 which fits over a tetrahedron base plate 59. As shown in FIG. 3, the base plate 59 has a center bore 60 which fits over axles 30 and 32. As shown best in FIG. 3, the rotatable octahedron cores 35 and the orbital octahedron cores 46 all slide onto their respective axles 30 and 32 and can be rotated perpendicular to the axis thereof while their position on the axles is maintained by the spring tensioning arrangements on the ends of the axles 30 and 32. Pressure is maintained on the component pieces by springs 61 mounted between base plates 59 and nuts 62. Washers 63 are positioned at both ends of each spring to allow for free rotation and to keep the spring ends from binding on component parts.

Interlock and support components 64 are provided to assist in mounting the eight heptahedrons to sphere 29. As shown, six of the pyramidal shaped support components 64 are positioned at each of the connecting base corners of the eight heptahedrons. The pyramidal shaped support components 64 each have an apex of their pyramids trancated to form a flat surface 65 as seen best in FIG. 1. The pyramidal shaped components 64, FIG. 3, provide support surfaces 66 which are perpendicular to axles 30 and 32. Support surfaces 66 provide a bearing surface for the pentagonal shaped components 39 and 40 to pivot upon as the respective heptahedrons are rotated.

Grooves 67 interlock with tongue 44 and 45 to secure pentagonal shaped components 39 and 40 to the toy. Grooves 68 also interlock with tongue 55 and 56 to secure pentagonal shaped components 49 and 50 to the toy. The combination of internal axles with spring tensioning members, as well as the tongue and groove raceway construction provides the means for anchoring all the components of the toy to the central sphere The individual composition of each of these components parts are illustrated in FIG. 4 through FIGS. 10D of the drawings.

Figure 12:
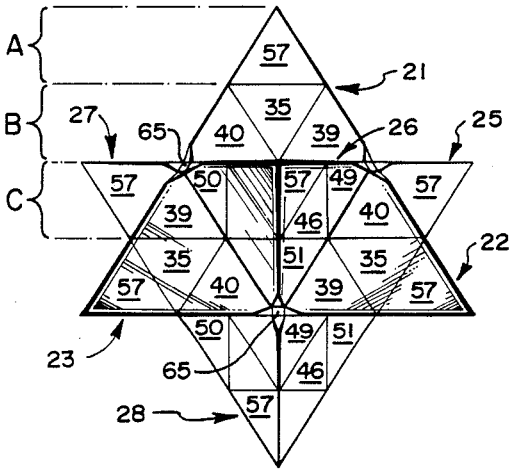

Heptahedrons 25 and 27, as seen in FIG. 3, are movable to orbit about sphere 29. It can be seen that as heptahedron 25 is moved clockwise about the top half of sphere 29 heptahedron 27 also moves clockwise to the location previously occupied by heptahedron 25. Both heptahedrons 25 and 27 move on their convex base plates 33. In FIGS. 11 through 15 the individual components are illustrated as the heptahedrons are orbited about the central sphere In FIG. 11 it can be seen that heptahedrons 25, 26 and 27 will orbit clockwise around the internal sphere 29. In making such rotation the user holds heptahedron 28 seen in FIG. 12 in a left hand, for example, and then uses the right hand to apply pressure to rotate heptahedron 25 clockwise to the position occupied by heptahedron 26. At the same time, 26 orbits to the space shown occupied by heptahedron 27 and heptahedron 27 orbits to the space vacated by heptahedron 25. Along with the rotation of heptahedrons 25, 26 and 27 the pentagonal shaped components 49 and 50 orbit with these heptahedrons, while pentagonal shaped components 51 that were previously part of these heptahedrons remain stationary. This is best shown in the front and side views of the toy, FIGS. 12 and 14 respectfully. In FIG. 12 three layers have been identified as layers A, B, and C. Layers A and B make up heptahedron 21 which is referred to as a rotatable heptahedron because its internal axles is anchored into the sphere 29. Layer C contains heptahedrons 25, 26 and 27 and as layer C is rotated clockwise the pentagonal shaped components 39 and 40 orbit about the internal sphere 29 (FIG. 12) along with this layer This is because heptahedrons 22 and 23 have internal axles that anchor into sphere 29. Pentagonal shaped components 51 seen in FIG. 12 cannot orbit with heptahedron 26 because they are blocked from rotating by heptahedrons 22 and 23. Should it be desired to rotate pentagonal shaped component 51 of heptahedron 26 with layer C, of FIG. 12, heptahedron 26 must first be rotated counterclockwise. In doing so pentagonal shaped component 51 rotates about internal axle 32 and is rotated to take the place of pentagonal shaped component 49, thereby positioning component 51 to be in layer C and to orbit around the internal sphere 29 with this layer.

Figure 14:
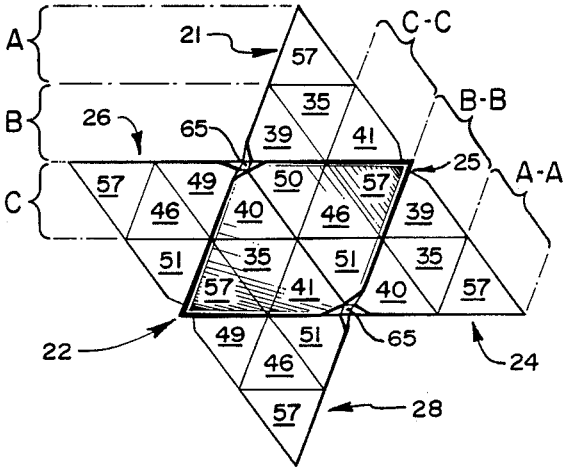
Figure 13:
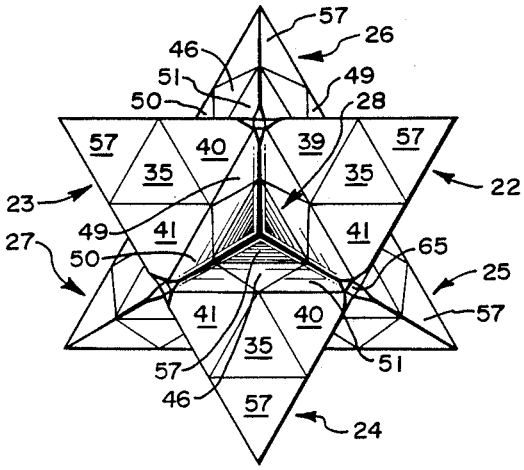
Figure 15:
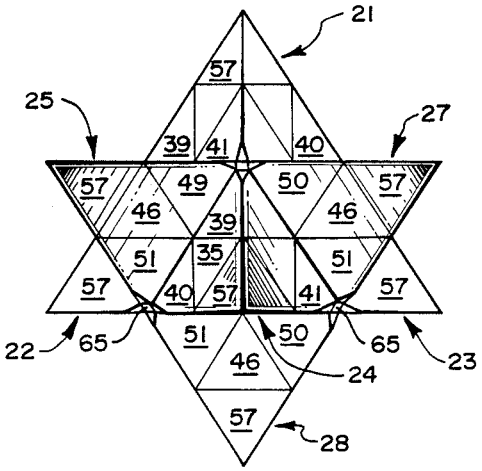

Other layers also orbit about the central sphere. As shown in FIG. 14 layers A—A, B—B and C—C may be so manipulated. Layer A—A contains only one component 57 which rotates about its internal axle 30. Layer B—B contains components 35, 39, 40 shown in FIG. 14, and component 41 shown in FIG. 11, 13 and 15. Layer B—B also rotates about its internal axle 32, thereby rotating the positions of components 35, 39, 40 and 41. Component 39, FIG. 14, is positioned to orbit with layer C around the central sphere 29. The components that make up layer C—C FIG. 14, are 57, 46, 49, 40, 50 and 39. It is important to remember that component 40 of layer B—B, FIG. 14, can be rotated upwardly about internal axle 32 of heptahedron 24 to occupy the same location as component 39. Thus component 40 would be in position to orbit with layer C.

Layer C—C orbits about sphere 29 and as seen in FIG. 14 is comprised of components 41, 57, 46 and 51. It should also be noted, as shown in FIG. 14, that heptahedron 21 has layer B that intersects layer C—C, with a resultant mixing of the pentagonal shaped components 41 and 40 with layer C—C as it orbits central sphere 29. In FIG. 14 the pentagonal shaped component 41 is shown in position to orbit with layer C—C. However, before layer C—C is orbited about sphere 29, layer B can be rotated about its internal axle 30 to move component 39 into the position occupied by component 41 and thereby placing component in position 39 to orbit with layer C—C.

The relationship of the moving layers can be followed on the toy by observing that all eight heptahedrons are constructed of two layers, previously described as layer A or layer B or as layer A—A and layer B—B, and these layers are rotated about the internal axles which anchor them to the sphere. Heptahedrons 21, 22, 23 and 24 each contain a stationary axle 30 that anchors directly into sphere 29, while heptahedrons 25, 26, 27 and 28 have axles 32 that anchor into convex base plates 33 and can be orbited around sphere 29. The third layer C or C—C is free to orbit about sphere 29. Layer C or C—C is mainly comprised of components of the movable or orbiting heptahedrons, however when layer C or C—C is orbiting it intersects with and carries three pentagonal shaped components from the rotating heptahedrons. Similarly, three pentagonal shaped components of the orbital heptahedrons are not orbited since they are locked into position by rotating heptahedrons, which do not orbit. Layer C shown in plan view in FIG. 11, and the three pentagonal shaped components 40 and 39 of heptahedrons 22, 23 and 24 respectively which orbit with layer C are seen also; however, the three pentagonal shaped components 51 of the orbital heptahedrons 25, 26 and 27 respectfully which are not rotated show best in FIGS. 12, 14 and 15.

In FIG. 14 rotatable heptahedron 21 is supported on layer C which orbits the sphere directly under layers A and B. The same is true for heptahedron 24 which is supported on layer C—C which orbits directly under layers A—A and B—B The orbiting of another similar layer beneath heptahedron 26, 21 and 28 is carried out in the same as orbiting of heptahedrons 21 and 24.

The capability of layers A, B and C, as well as layers A—A and B—B and C—C to rotate results in a toy having unusual positioning movements that challenges the user to achieve desired component pattern arrangements.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A multi-faceted toy comprising eight heptahedrons;

a central sphere;

axle means mounting four of the said heptahedrons to the central sphere, whereby said four heptahedrons are each rotatable about an axle;

at least four convex base plates, each mounted to orbit around the central sphere; and axle means mounting one of said heptahedrons to one of the base plates, whereby said one heptahedron is movable with said base plate and is rotatable about said axle means.

2. A multi-faceted toy as in claim 1, wherein each convex base plate is locked to the sphere by raceways.

3. A multi-faceted toy as in claim 2, wherein each heptahedron includes five components secured to a core octohedron component.

4. A multi-faceted toy as in claim 3, wherein the core octohedron component is shaped as an irregular octohedron having a concave base surface that aligns with the surface of the central sphere.

5. A multi-faceted toy as in claim 4, wherein each core octohedron component has a continuous grooved raceway around a perimeter edge of said concave base surface as a portion of a raceway.

6. A multi-faceted toy as in claim 5, wherein three of the five components secured to the said core octohedron component are identical pentagonal shaped components secured to central core pieces and to other adjacent components by tongue and groove connectors.

7. A multi-faceted toy as in claim 6, wherein each of the eight heptahedrons has a triangular shaped tetrahedron component attached thereto by an axle, with each said tetrahedron being rotatable about its axle.

8. A multi-faceted toy as in claim 7, wherein means are provided to resiliently bias each tetrahedron on its axle towards the central sphere.

* * * * *